US010499157B2

(12) United States Patent
Wu et al.

(10) Patent No.: US 10,499,157 B2
(45) **Date of Patent: *Dec. 3, 2019**

(54) VIBRATION DIAPHRAGM

(71) Applicant: AAC Technologies Pte, Ltd., Singapore (SG)

(72) Inventors: Meiwei Wu, Shenzhen (CN); Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 156 days.

This patent is subject to a terminal disclaimer.

(21) Appl. No.: 15/819,138

(22) Filed: Nov. 21, 2017

(65) Prior Publication Data

US 2018/0367907 A1 Dec. 20, 2018

(30) Foreign Application Priority Data

Jun. 20, 2017 (CN) ..... 2017 2 0723753 U

(51) Int. Cl.
*H04R 7/12* (2006.01)
*G10K 13/00* (2006.01)
*H04R 7/18* (2006.01)

(52) U.S. Cl.
CPC ..... *H04R 7/127* (2013.01); *G10K 13/00* (2013.01); *H04R 7/18* (2013.01)

(58) Field of Classification Search
CPC ... H04R 7/17; H04R 7/18; H04R 7/20; H04R 7/22; H04R 7/24; H04R 31/003; H04R 31/006; H04R 2307/204; H04R 2307/207
See application file for complete search history.

(56) References Cited

U.S. PATENT DOCUMENTS 2,439,665 A * 4/1948 Marquis ..... H04R 7/20 181/169
6,957,714 B2 * 10/2005 Takahashi ..... H04R 7/20 181/171
7,946,378 B2 * 5/2011 Windischberger ..... H04R 7/20 181/157
9,027,700 B2 * 5/2015 Kim ..... H04R 7/02 181/171

* cited by examiner

*Primary Examiner* — Brian Ensey
(74) *Attorney, Agent, or Firm* — IPro, PLLC; Na Xu

(57) ABSTRACT

The present disclosure provides a vibration diaphragm. The vibration diaphragm includes a central dome part; a suspension part surrounding the dome part; a number of first reinforcing parts disposed on the suspension part; a number of second reinforcing parts disposed on the suspension part and being adjacent to the first reinforcing parts. The second reinforcing part includes a first master extension part and a first slave extension part, and the first master extension part and the first slave extension part cross with each other.

6 Claims, 2 Drawing Sheets

VIBRATION DIAPHRAGM

FIELD OF THE PRESENT DISCLOSURE

The present disclosure relates to electro-acoustic transducers, more particularly to a vibration diaphragm for radiating audible sounds.

DESCRIPTION OF RELATED ART

With the rapid development of portable devices like mobile phone etc, people's requirement to the performance of the product is becoming stronger and stronger, and there is a vibration mode of music belt for the music appreciation of the mobile phone, in order to strengthen the entertaining effect, thus, the development of the sounding instrument is accelerating accordingly.

The sounding instrument with relevant technology comprises a frame, a vibration diaphragm supported on the frame and a voice coil driving the vibration of the vibration diaphragm. The vibration diaphragm comprises a dome and a suspension extending along the dome, and the voice coil is fixed on the suspension.

However, in the vibration diaphragm with relevant technologies, the dome is a simple plane structure, and this structure makes the acoustic performance of the vibration diaphragm not improved further, and affects badly the acoustic performance of the vibration diaphragm.

Therefore it is necessary to provide an improved vibration diaphragm for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
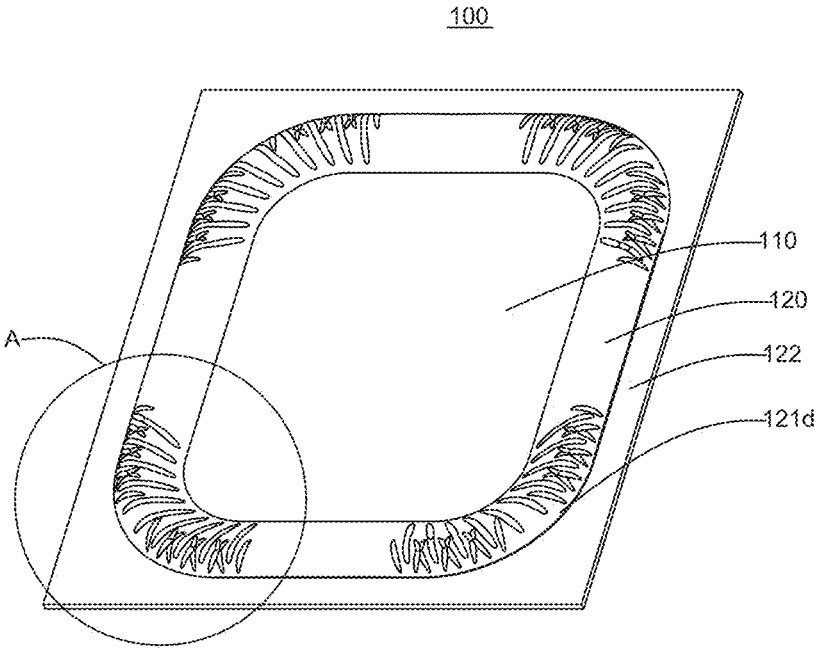
FIG. 1 is an illustrative isometric view of a vibration diaphragm in accordance with an exemplary embodiment of the present disclosure.
Figure 2:
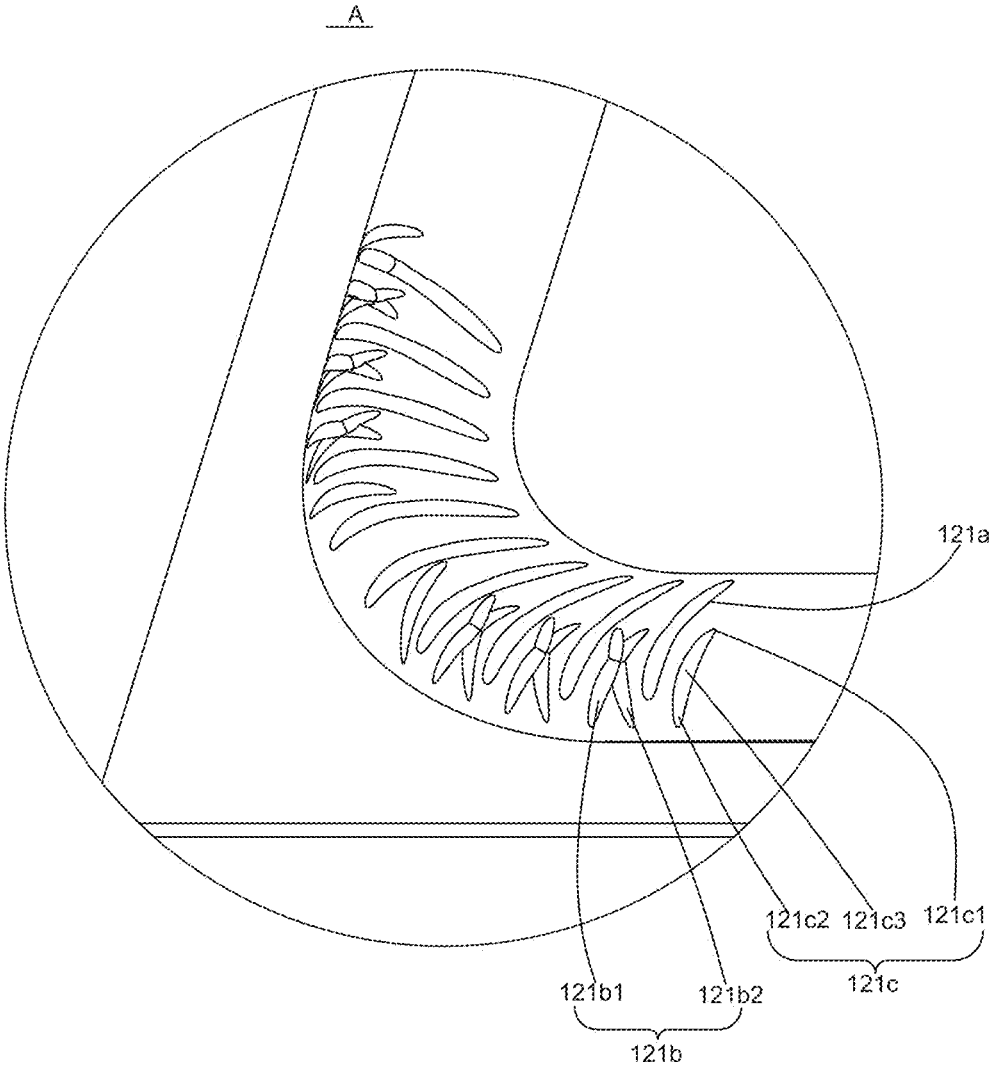
FIG. 2 is an enlarged view of Part A of the vibration diaphragm in FIG. 1.

As shown in FIG. 1 and FIG. 2, a vibration diaphragm 100 in accordance with an exemplary embodiment of the present disclosure is herein disclosed. The vibration diaphragm 100 is mainly applied in the sounding device of electronic equipment. The sounding device typically comprises a magnetic circuit system and a vibration system, wherein the magnetic circuit system comprises a yoke and a magnet steel accommodated in the yoke, and there is a magnetic gap between the yoke and the magnet; and the vibration system comprises a voice coil suspended in the magnetic gap and the vibration diaphragm 100 which is connected with the voice coil and driven by the same to vibrate.

The vibration diaphragm 100 comprises a central dome part 110, a suspension part 120 encircling the dome part 110 and a fixation part 122 extending outwards from the suspension part 120, where the suspension part 120 has an annular, protruding shape. That is to say, the suspension part 120 is provided to surround the central dome part 110.

The suspension part 120 is provided with a number of first reinforcing parts 121*a* and a number of second reinforcing parts 121*b*, and the first reinforcing parts 121*a* and the second reinforcing parts 121*b* are provided spaced apart, which significantly improves the strength of the vibration diaphragm 100, reduces the vibration diaphragm collapsing, prolongs the life of the vibration diaphragm and allows the sounding device using the vibration diaphragm 100 to have an excellent vibration performance.

It should be noted that no limitation is made to the structures of the first reinforcing parts 121.*a* and the second reinforcing parts 121*b*, for example, their protruding direction may be the same as or opposite to that of the suspension part 120; no limitation is made herein.

It should be understood that the first reinforcing parts 121*a* and the second reinforcing parts 121*b* are provided spaced apart, which may include: the first reinforcing parts 121*a* and the second reinforcing parts 121*b* are alternately arranged one by one, or a (or more) second reinforcing part(s) 121*b* is arranged every one or more first reinforcing part(s) 121*a*, or other arrangements.

As shown in FIG. 2, the second reinforcing parts 121*b* comprise a first master extension part 121*b*1 and a first slave extension part 121*b*2, and the first master extension part 121*b*1 and the first slave extension part 121*b*2 cross with each other.

It should be understood that the crossing of the first master extension part 121*b*1 and the first slave extension part 121*b*2 may be as follows: the first master extension part 121*b*1 and the first slave extension part 121*b*2 cross at a point from which both parts extend to two sides, i.e. to roughly form a X shape, or the first master extension part 121*b*1 and the first slave extension part 121*b*2 cross at a point from which the first master extension part 121*b*1 extends to two sides and the first slave extension part 121*b*2 extends to one side, i.e. to roughly form a Y shape, or the first master extension part 121*b*1 and the first slave extension part 121*b*2 cross at a point from which the first master extension part 121*b*1 and the first slave extension part 121*b*2 extend to one side, i.e. to roughly form a V shape. Of course, the first master extension part 121*b*1 and the first slave extension part 121*b*2 may be configured to have other shapes, etc.

As shown in FIG. 1, the suspension part 120 roughly take a rectangular shape, both the first reinforcing parts 121*a* and the second reinforcing parts 121*b* may be located at the corner 121*d* of the suspension part 120, and both the first reinforcing parts 121*a* and the second reinforcing parts 121*b* extend from the outside of the corner 121*d* to the inside of the corner 121*d*. Wherein the inside of the suspension part 120 is the side close to the dome part 110, and its outside is the side away from the dome part 110.

In the vibration diaphragm 100 of the structure according to the embodiment, the provision of the first reinforcing parts 121*a* and the second reinforcing parts 121*b* at the corner 121*d* of the suspension part 120 can effectively improve the strength of the vibration diaphragm 100 at the corner 121*d* and reduce the collapsing of the vibration diaphragm.

As shown in FIG. 2, in order to further improve the strength of the vibration diaphragm 100, the suspension part 120 is also provided with a number of third reinforcing parts 121*c*. Wherein, each third reinforcing part 121*c* is provided spaced apart from the first reinforcing parts 121*a* and the second reinforcing parts 121*b*, and there is an included angle between each third reinforcing part 121*c* and the extension direction of its adjacent first reinforcing part 121*a*.

It should be understood that the included angle between the third reinforcing part 121*c* and the extension direction of its adjacent first reinforcing part 121*a* may be 0~90°, that is to say, the first reinforcing parts 121*a* may be in parallel with the third reinforcing parts 121*c*, or there may be an angle between the first reinforcing parts 121*a* and the third reinforcing parts 121*c*, for example, 45°.

In the vibration diaphragm 100 of the structure according to the embodiment, the provision of the third reinforcing parts 121*c* on the suspension part 120 can further improve the strength of the vibration diaphragm 100 and reduce the vibration diaphragm collapsing.

As shown in FIG. 2, specifically, the third reinforcing part 121*c* comprises a second master extension part 121*c*1, a second slave extension part 121*c*2 and a connecting part 121*c*3 connecting the second master extension part 121*c*1 and the second slave extension part 121*c*2. Wherein, the second master extension part 121*c*1 and the second slave extension part 121*c*2 are located at two ends of the connecting part 121*c*3 respectively, and the width of at least one of the second master extension part 121*c*1 and the second slave extension part 121*c*2 is less than that of the connecting part 121*c*3.

It should be understood that the width of at least one of the second master extension part 121*c*1 and the second slave extension part 121*c*2 is less than that of the connecting part 121*c*3, which may be as follows: the width of the second master extension part 121*c*1 may be less than that of the connecting part 121*c*3, and the width of the second slave extension part 121*c*2 may be less than that of the connecting part 121*c*3, or the widths of both the second master extension part 121*c*1 and the second slave extension part 121*c*2 are less than that of the connecting part 121*c*3 which is preferable.

In the vibration diaphragm 100 of the structure according to the embodiment, the width of at least one of the second master extension part 121*c*1 and the second slave extension part 121*c*2 is less than that of the connecting part 121*c*3, which can further improve the strength of the vibration diaphragm 100 at the corner 121*d* and reduce the vibration diaphragm collapsing; besides, the vibration diaphragm 100 of the structure can be also easily fabricated and requires less cost.

As shown in FIG. 2, specifically, the structure of both the first reinforcing parts 121*a* and the second reinforcing parts 121*b* may be a depression part sinking in the surface of the suspension part 120.

Of course, another structure of both the first reinforcing parts 121*a* and the second reinforcing parts 121*b* may be a protrusion part rising from the surface of the suspension part 120.

In the vibration diaphragms 100 of both structures described above, the strength of the vibration diaphragm at the corner 121*d* can be effectively improved and the vibration diaphragm collapsing is reduced. Taking the convenience of fabricating processes into consideration, the first reinforcing parts 121*a* and the second reinforcing parts 121*b* of the first structure are preferable, i.e. both the reinforcing parts are depression parts sinking in the surface of the suspension part 120.

In order to further improve the strength of the vibration diaphragm, the corners 121*d* of the suspension 120 are rounded off.

A sounding device is provided according to the second aspect of the present utility model (not shown in figures). The sounding device comprises a magnetic circuit system (not shown in figures), a vibration system (not shown in figures) and a frame accommodating the magnetic circuit system and the vibration system (not shown in figures), wherein the vibration system includes the vibration diaphragm 100 described above.

The sounding device of the structure according to the embodiment includes the vibration diaphragm 100 described above. The vibration diaphragm 100 of such a structure has improved strength and does not collapse easily, so the life of the sounding device is prolonged and its vibration effect is improved.

An electronic equipment (not shown in figures) is provided according to the third aspect of the present utility model, and the electronic equipment comprises the sounding device described above.

The electronic equipment of the structure according to the embodiment has the sounding device described above which has the vibration diaphragm 100 described above, the vibration effect of the electronic equipment is effectively improved and the life of the product is prolonged.

It should be noted that the electronic equipment may comprise electronic products such as cell phones, tablets.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A vibration diaphragm comprising:

a central dome part;

a suspension part surrounding the dome part;

a number of first reinforcing parts disposed on the suspension part;

a number of second reinforcing parts disposed on the suspension part and being adjacent to the first reinforcing parts; wherein the second reinforcing part comprises a first master extension part and a first slave extension part, and the first master extension part and the first slave extension part cross with each other; and the suspension part further includes a number of third reinforcing parts, the third reinforcing parts are spaced apart from the first reinforcing parts and the second reinforcing parts, and an included angle is formed between each third reinforcing part and an adjacent first reinforcing part.

2. The vibration diaphragm as described in claim 1, wherein both the first reinforcing parts and the second reinforcing parts may be located at the corner of the suspension part, and both the first reinforcing parts and the second reinforcing parts extend from an outside of the corner to an inside of the corner.

3. The vibration diaphragm as described in claim 1, wherein the third reinforcing part comprises a second master extension part, a second slave extension part and a connecting part connecting the second master extension part and the second slave extension part, the second master extension part and the second slave extension part are located at an end of the connecting part respectively, and a width of at least one of the second master extension part and the second slave extension part is less than that of the connecting part.

4. The vibration diaphragm as described in claim 1, wherein both the first reinforcing parts and the second reinforcing parts are depression parts sinking in the suspension part.

5. The vibration diaphragm as described in claim 1, wherein both the first reinforcing parts and the second reinforcing parts are protrusion parts rising from the suspension part.

6. The vibration diaphragm as described in claim 1, wherein corners of the suspension part are rounded off.

* * * * *